US005529825A

United States Patent [19]

Sutherland

[11] Patent Number: 5,529,825

[45] Date of Patent: Jun. 25, 1996

[54] MATTING

[75] Inventor: Thomas L. Sutherland, Newton Stewart, United Kingdom

[73] Assignee: Caledonia Matting Limited, Stranraer, Scotland

[21] Appl. No.: 232,132

[22] PCT Filed: Oct. 26, 1992

[86] PCT No.: PCT/GB92/01965

§ 371 Date: Apr. 24, 1994

§ 102(e) Date: Apr. 24, 1994

[87] PCT Pub. No.: WO93/07789

PCT Pub. Date: Apr. 29, 1993

[30] Foreign Application Priority Data

Oct. 25, 1991 [GB] United Kingdom ..... 9122727

[51] Int. Cl.[6] ..... B32B 3/02

[52] U.S. Cl. ..... 428/88; 428/95; 428/167; 428/172; 156/244.11; 156/244.15; 264/177.1; 264/257; 5/417

[58] Field of Search ..... 428/156, 167, 428/172, 81, 88, 95, 85, 192; 156/60, 244.11, 244.15; 264/177.1, 257, 514; 5/417

[56] References Cited

U.S. PATENT DOCUMENTS

| | | | |
|---|---|---|---|
| 1,384,891 | 7/1921 | Gothberg . | |
| 2,436,315 | 2/1948 | Liberatore | 15/112 |
| 4,408,365 | 10/1983 | Palmer | 428/188 |
| 4,587,148 | 5/1986 | Campbell et al. | 428/88 |

*Primary Examiner*—Donald J. Loney
*Attorney, Agent, or Firm*—Howard & Howard

[57] ABSTRACT

Entrance matting includes a flexible base layer (12) and a flexible upper layer (14) comprising spaced, upstanding strips (16) and defining slots (18) therebetween. Strips of carpet and the like (20) are fixed in the slots (18). The matting is located on a floor at a building entrance with the strips (16, 20) perpendicular to the direction of traffic over the matting for use in scraping dirt and taking moisture from the feet of people entering the building.

16 Claims, 1 Drawing Sheet

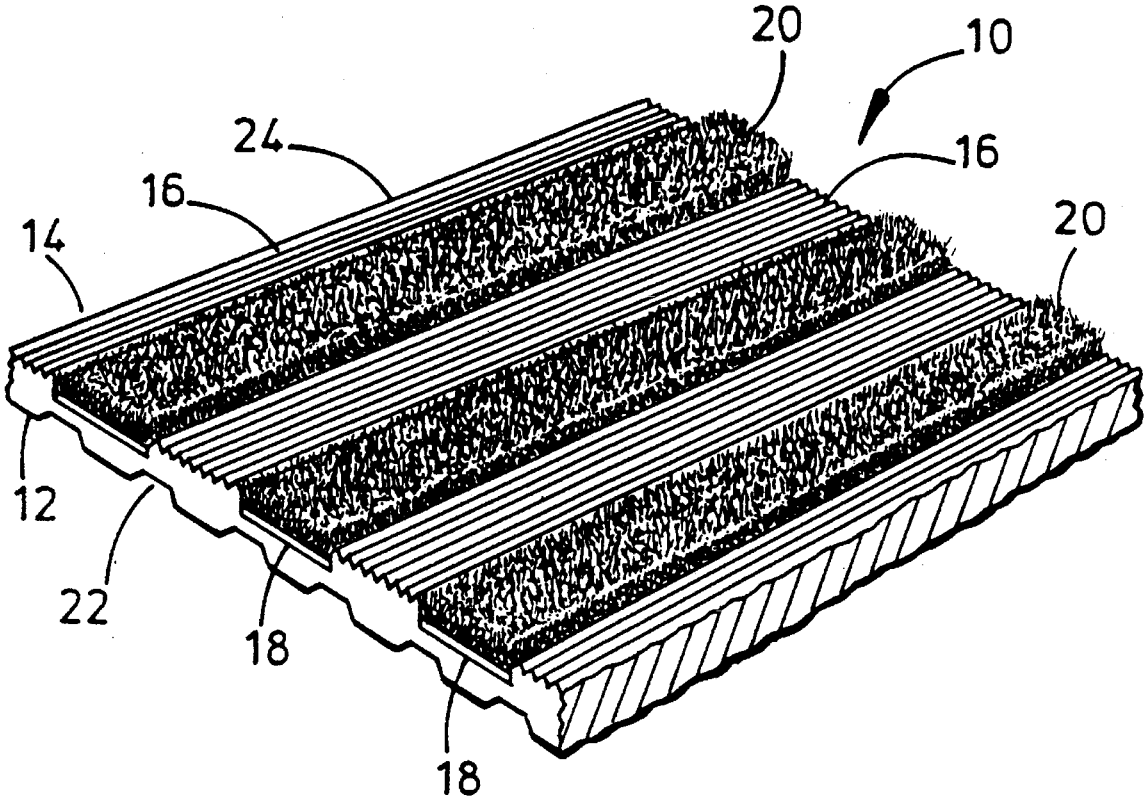
20
10
24
16
16
14
20
12
22
18
18

MATTING

FIELD OF THE INVENTION

This invention relates to improvements in matting, and in particular, but not exclusively, to entrance matting of the type commonly found at entrances of stores, offices and public buildings.

BACKGROUND OF THE INVENTION

In order to minimise the amount of dirt and water carried into buildings on the feet of people entering the building, entrance mats are placed inside doorways. For domestic or other light use applications coir type or throw down matting is used, although this has only a limited life span. The majority of high traffic applications require the use of mats formed of metal or plastic extrusions, typically of aluminium or PVC, pieced together by wire or other forms of coupling. Such mats are hard wearing but tend to be expensive and, due to the nature of their construction, are commonly supplied in standard sizes or must be made to order. Also, the presence of metal in the mats may affect the operation of security devices which are used in stores to detect the unauthorised removal of goods from the store. Further, this form of mat will often move under the feet, which may be unsettling, and the gaps between the extrusions provide traps for heels and the points of walking sticks. In mats manufactured without the use of metal, solid, extruded PVC has been utilised although it has been found that the hard PVC used tends to break up after a relatively short period of use.

It is an object of the present invention to provide an improved entrance matting which obviates or mitigates these disadvantages.

SUMMARY OF THE INVENTION

According to one aspect of the present invention there is provided matting including: a flexible base layer; a flexible upper layer comprising spaced upstanding strips and defining slots therebetween; and strips of carpet and the like located in the slots to define a substantially planar upper surface.

As used herein, the term "carpet" is intended to encompass carpet, matting, coir and the like. The provision of a substantially planar upper surface avoids the possibility of heels, walking sticks and the like becoming trapped between the upstanding strips and the strips of carpet and minimises the possibility of persons tripping on the matting.

The base layer is preferably solid and is formed of a suitable flexible material such as rubber or soft PVC. The upper layer may be of similar material. The material selected should conform to appropriate standards relating to fire resistance and the like.

Preferably, the matting is provided in the form of a relatively large area continuous slab. This arrangement allows a single-piece of matting to be cut to size for most applications, avoiding the presence of joins between mat sections thus avoiding the formation of potential dirt traps and the occurrence of increased mat wear at the joins. Also, the larger area covered by a single slab is better adapted to cover an uneven area which might otherwise result in visible gaps at joins between multipiece matting. Further, fitting of a one-piece mat is easier than fitting a mat formed of a number of tiles or sections as all that is required is that the matting is cut to size.

The upper surface of the spaced strips is preferably ribbed to facilitate use of the strips as shoe scrapers. The carpet and the like located in the slots between the strips also serves a scraping function, particularly for smaller particles and dust, and will also retain water.

The arrangement of strips facilitates cleaning as dirt may be swept from the strips of carpet and the like and escape from the carpet at the boundary between the carpet and the adjacent raised strips.

The absence of metal clips, ties or scrapers in the matting facilitates manufacture and will not interfere with the operation of security systems at store entrances. Further, the matting may be cut on-site, without requiring the provision of specialised cutting tools.

The matting is flexible and thus will sit securely, without rocking, on uneven flooring as often occurs with conventional matting on screeded concrete floors.

The base layer and the strips of the upper layer may be integral or may be separately formed and then bonded together.

The carpet and the like may be bonded to the upper surface of the base layer. The colour and form of the carpet and the like will typically be selected to match with the surrounding floor coverings, thus providing entrance matting which is more attractive and less obtrusive. Most preferably, the carpet and the like is secured in the slots by pressure sensitive adhesive. Thus, if desired, the strips of carpet and the like may be peeled out of the slots and replaced. Also, such an adhesive allows for differential expansion between the carpet and the like and the flexible layers. This feature is particularly useful in applications where the matting is exposed to extremes of temperature and the absence of the feature would result in damage to the mat. The allowance for such differential expansion also increases the varieties of material that may be used in the matting.

Preferably also, the underside of the base layer defines a plurality of lateral or longitudinal flutes to allow for ventilation between the matting and its supporting substrate.

According to another aspect of the present invention there is provided a method of producing matting comprising extruding a slab of flexible substrate including a base layer and an upper layer comprising spaced strips and defining slots therebetween, providing strips of carpet and the like, and adhering the strips of carpet and the like in the slots.

Preferably, the flexible substrate is formed as a relatively large area slab and is cut to size for fitting.

BRIEF DESCRIPTION OF THE DRAWING

These and other aspects of the present invention will now be described, by way of example, with reference to the accompanying drawing which shows a perspective view of a portion of matting in accordance with a preferred embodiment of the present invention.

DESCRIPTION OF THE PREFERRED EMBODIMENTS

The entrance matting 10 comprises a rubber base layer 12 and an upper layer 14 comprising a plurality of spaced rubber strips 16 and defining slots 18 for receiving strips of carpet 20.

The base layer 12 and upper layer 14 are formed of a single rubber extrusion. The extrusion is in the form of a relatively large area slab, and the drawing illustrates only a portion of such a slab. The extrusion may be formed with the slots 18 thereon, or these may be subsequently cut from the extrusion. The lower surface of the base layer 12 is ribbed 22 to provide air channels between the lower face of the matting and the floor which will support the matting. The upper surface of the rubber strip 16 is also ribbed 24 to facilitate use of the strips as scrapers. In use, the ribs 24 and the strips of rubber and carpet 16, 20 will be positioned perpendicular to the direction of traffic over the matting.

The strips of carpet 20 are sized to fit snugly within the slots 18 with the upper surface of the carpet is substantially level with the adjacent strips 16 to provide a surface which will not catch high heels, the tips of walking sticks or umbrellas and the like. Also, the planar surface allows cleaning of the matting using conventional vacuum cleaners. The strips 20 are secured in the slots using a suitable pressure sensitive adhesive. The form of carpet may vary depending on the application and the decor of the surrounding area. In certain application other materials, such as coir or coconut matting may be utilised in place of carpet.

In use, the ribbed, rubber strips 16 act as scrapers for larger particles of dirt while the strips of carpet 20 will be effective to remove dust and smaller particles of dirt and will also retain water. The rubber strips 16 may be cleaned by sweeping and the arrangement of the carpet in strips also facilitates cleaning as the boundaries between the strips of carpet 20 and the rubber strips 16 provides a means of escape for dirt swept from the carpet.

The rubber used to form the matting is flexible such that the matting will deform and will sit, without rocking, on uneven floors. The matting, after being cut to size, may be placed with a specially provided depression in a doorway, or may be provided with ramped edges for location on an existing, level floor.

It will be clear to those having skill in the art that the above described embodiment is merely exemplary of the present invention that various modifications and improvements may be made to the invention without departing from the scope of the invention. The above described embodiment is formed from a single rubber extrusion, though the base layer and rubber strips could be formed separately and bonded together after forming. Also, other materials such as soft PVC, may be used in place of rubber to provide the base layer and scraper strips.

I claim:

1. Matting including: a flexible base layer; a flexible upper layer comprising spaced, upstanding strips and defining upper scraper surfaces with continuous slots therebetween defined between sidewalls of adjacent strips; and strips of carpet located in and extending along the slots to define, together with said upper scraper surfaces, a substantially planar upper matting surface, said carpet strips fitting snugly between said sidewalls to substantially fill said slots.

2. The matting of claim 1, wherein the base layer and the upper layer are integral.

3. The matting of claim 1, wherein the base layer and the upper layer are formed of a material selected from rubber or soft PVC.

4. The matting of claim 1, wherein the upper surfaces of the upstanding strips are ribbed.

5. The matting of claim 1, wherein the base layer and upper layer are in the form of a relatively large area integral slab.

6. The matting of claim 1, wherein the strips of carpet are releasably secured in the slots.

7. The matting of claim 1, wherein the underside of the base layer defines a plurality of longitudinal flutes to allow for ventilation between the matting and a supporting substrate.

8. A method of producing matting comprising the steps of: extruding a slab of flexible substrate including a base layer and an upper layer; forming the upper layer to define spaced strips defining upper scraper surfaces with continuous slots therebetween defined between sidewalls of adjacent strips; providing strips of carpet; and adhering the strips of carpet in the slots to lie along the slots and sizing said strips such that they fit snugly between said sidewalls.

9. The method of claim 8, wherein the spaced strips and slots of the upper layer are formed as the substrate is extruded.

10. Entrance matting including: a flexible base layer; a flexible upper layer comprising spaced, upstanding strips and defining a plurality of ribbed scraper surfaces with continuous slots therebetween, the base layer and the upper layer being integral and formed of a material selected from rubber or soft PVC; and lengths of carpet located in and extending along the slots such that the carpet and the scraper surfaces collectively define a substantially planar upper matting surface.

11. Entrance matting as recited in claim 10, wherein said slots are defined between adjacent sidewalls of said upstanding strips, and said lengths of carpet fit snugly between said adjacent sidewalls to substantially fill said slots.

12. Entrance matting as recited in claim 10, wherein said lengths of carpet are formed as strips that are connected to said slots by an adhesive.

13. Matting as recited in claim 1, wherein said strips of carpet are secured within said slots by an adhesive.

14. Matting as recited in claim 1, wherein there are a plurality of ribbed scraper surfaces formed on said upstanding strips to define said upper scraper surfaces.

15. A method as recited in claim 8, wherein said strips of carpet are adhered in said slots by an adhesive.

16. A method as recited in claim 8, wherein said upper scraper surfaces are defined by forming a plurality of ribs on said spaced strips.

* * * * *